US006625948B2

(12) United States Patent
Valente

(10) Patent No.: US 6,625,948 B2
(45) Date of Patent: Sep. 30, 2003

(54) ELEMENT MADE FROM BRICK MATERIAL AND METHOD FOR MANUFACTURING PREFABRICATED PANELS FOR BUILDING CONSTRUCTION

(76) Inventor: Carmine Franco Valente, Via Arbostra 25d, CH-6963 Pregassona (CH)

( * ) Notice: Subject to any disclaimer, the term of this patent is extended or adjusted under 35 U.S.C. 154(b) by 0 days.

(21) Appl. No.: 10/035,232

(22) Filed: Jan. 4, 2002

(65) Prior Publication Data

US 2003/0000167 A1 Jan. 2, 2003

(30) Foreign Application Priority Data

Jul. 2, 2001 (CH) ..... 1208/01

(51) Int. Cl.[7] ..... E04C 2/04

(52) U.S. Cl. ..... 52/602; 52/574; 52/606; 52/611; 52/742.14; 52/745.1

(58) Field of Search ..... 52/574, 602, 606, 52/611, 742.14, 742.13, 745.1, 745.13, 747.12

(56) References Cited

FOREIGN PATENT DOCUMENTS

EP 0921243 6/1999

*Primary Examiner*—Brian E. Glessner

(74) *Attorney, Agent, or Firm*—Greenblum & Bernstein, P.L.C.

(57) ABSTRACT

Brick material building element and method of building with the element, wherein the brick material building element includes a base having a length, a first side, a second side, an inner surface, and an outer surface, whereby a width is defined by a distance between the first side and the second side. A longitudinal protrusion is formed on the first side of the base. A longitudinal recess is formed on the second side of the base. A main protrusion extends from the base. The main protrusion has a surface which is shorter than the length of the base. At least one longitudinal through opening is disposed in at least one of the base and the main protrusion. The longitudinal protrusion includes an external shape which is complementary to and adapted to fit within the longitudinal recess of another brick material building element. The method includes arranging at least two brick material building elements near each other and connecting the at least two brick material building elements using at least one of a mortar, a cement and a concrete.

43 Claims, 12 Drawing Sheets

ELEMENT MADE FROM BRICK MATERIAL AND METHOD FOR MANUFACTURING PREFABRICATED PANELS FOR BUILDING CONSTRUCTION

CROSS-REFERENCE TO RELATED APPLICATIONS

The present application claims priority under 35 U.S.C. §119 of Swiss Patent Application No. 2001 1208/01, filed on Jul. 2, 2001, the disclosure of which is expressly incorporated by reference herein in its entirety.

BACKGROUND OF THE INVENTION

1. Field of the Invention

The present invention concerns a particular element made from brick material for application in the manufacture of prefabricated wall and ceiling panels for housing construction.

2. Description of Related Art

Elements of this type made from brick material are known from practical use and from patent literature. In particular, EP 0 921 243, represents the state of the art which is closest to the present invention. This document discloses an element made from brick material, its application and how it is possible to achieve a whole series of important advantages therewith. This element has a U-shaped cross-section with a base and two wings. The base as well as the wings have at least one longitudinal opening which each pass through the whole length of the element. The element has two outer sides with one side having a protrusion and the other side having a recess of complementary form. This design is suitable for forming a slide-in joint over the whole length of the element. Moreover, the two face sides of the element are inclined with respect to the plane extending at right angles to the longitudinal direction of the element, at least over a portion of their surfaces.

Experience has shown that this U-shaped element, even if it permits achievement of the advantages cited in EP 0 921 243, still presents a number of disadvantages. These disadvantages are to be overcome with the help of the present invention. For example, this known element does not permit the achievement of a strong connection. At the connection point, shown in the example of FIGS. 7 and 8, the resulting layer of concrete mortar proves to be relatively thin. Another weak point of the known element is that, if panels with superimposed elements are produced, as shown in a cross-section in FIG. 8, the cross-section area for the passage of a tube for appliances, which is not brought into contact with reinforcing rods, turns out to be small and the resulting cross-sectional areas of concrete and steel are thus weak. Furthermore, the longitudinal bores extending through the whole length of the elements each have an insufficiently small cross-sectional area for the arrangement of e.g., an electric switch box.

As a result of these limitations, only a small number of panel types can be realized using the known element and they are applicable only for housing constructions of up to three floors.

SUMMARY OF THE INVENTION

The invention provides an element made from brick material which can be used to produce more robust panels. These panels can in turn be used for housing structures of up to six floors. The element is also more flexible than the conventional element in that it may be used in a variety of applications. This flexibility also permits the element to be used in the production of other products such as, e.g., cases for roller shutters, beams, lintels, etc. Furthermore, the design of the instant element will be less expensive, because of the shorter drying phases which are required to produce them. These objectives have been achieved owing to the studies and the research on the system proposed. The element is the product of a re-valuation of the application of the known materials, and was developed with cost reduction in mind and using the new technology of modular prefabrication. Thus, the invention provides an end product with better characteristics of profits and quality.

Studies on the characteristics and the behavior of clay have permitted the formulation of new details, all achieved using one single component, which is easy to apply in industrial processes.

The element is such that time required for building constructions using them are optimized. Such may be made independent of meteorological conditions, particularly during winter times, so that transport problems can be eliminated.

The present invention also permits building without limits concerning the styles of buildings or their structural requirements. The element is flexible enough to create many structures.

The invention also provides for a brick material building element that includes a base comprising a length, a first side, a second side, an inner surface, and an outer surface, whereby a width is defined by a distance between the first side and the second side. A longitudinal protrusion is formed on the first side of the base. A longitudinal recess is formed on the second side of the base. A main protrusion extends from the base. The main protrusion comprises a surface which is shorter than the length of the base. At least one longitudinal through opening is disposed in at least one of the base and the main protrusion. The longitudinal protrusion comprises an external shape which is complementary to and adapted to fit within the longitudinal recess of another brick material building element.

The main protrusion may comprise at least one inclined end. The at least one inclined end may extend from the base to the surface of the main protrusion. The at least one inclined end may comprise two inclined ends. Each of the two inclined ends may extend from the base to the surface of the main protrusion. The main protrusion may be centrally positioned on the inner surface of the base. The main protrusion may comprise a first inner inclined surface and a second inner inclined surface. The main protrusion may comprise two longitudinal through openings. Each of the base and the main protrusion may comprise at least one longitudinal through opening. The main protrusion may be centrally located with respect to the width of the base.

The base may comprise a plurality of longitudinal through openings and the main protrusion may comprise at least one longitudinal through opening. The building element may further comprise at least one wall separating at least two of the plurality of longitudinal through openings in the base. The base may comprise at least two longitudinal through openings and the main protrusion may comprise at least two longitudinal through openings. The building may further comprise at least one wall separating at least two of the plurality of longitudinal through openings of the base and at least one wall separating the at least two longitudinal through openings of the main protrusion. At least one of the walls may have a thickness which is less than a width of at least one of the longitudinal through openings. The at least one of the walls may have a thickness which is less than a width of at least one of the longitudinal through openings.

The main protrusion may comprise a height which, when measured from the inner surface of the base, is approximately equal to a distance between the inner surface of the base and an outer surface of the base. Each of the longitudinal protrusion and the longitudinal recess may comprise tapered surfaces. The main protrusion may comprise at least one inclined end and an angle $\alpha$ of inclination may range between approximately 30° to approximately 75°. The length may range between approximately 50 cm to approximately 100 cm. The width may range between approximately 30 cm to approximately 60 cm. A height "H" may be defined by a distance between the surface of the main protrusion and an outer surface of the base, and the height may range between approximately 10 cm to approximately 28 cm.

A height "h" of the base may be defined by a distance between the inner surface of the base and an outer surface of the base, and the height h may be approximately equal to half of the height H.

The building may further comprise an insulating material disposed with the at least one longitudinal through opening. The insulating material may be adapted to improve a K value of the element. The insulating material may comprise a thermal insulation material. The main protrusion may comprise at least one recess. The surface of the main protrusion may comprise at least one recess. The main protrusion may comprise at least one V-shaped recess. The surface of the main protrusion may comprise a plurality of V-shaped recesses. The main protrusion may comprise at least one recess whose depth is approximately equal to half a distance between the inner surface of the base and the surface of the main protrusion. The at least one recess may be adapted to receive at least one of a reinforcing member and mortar.

The invention also provides for a method of building a structure using a plurality of brick material building elements which each comprise a base comprising a length, a first side, a second side, an inner surface, and an outer surface, whereby a width is defined by a distance between the first side and the second side, a longitudinal protrusion formed on the first side of the base and a longitudinal recess formed on the second side of the base. A main protrusion extends from the base, the main protrusion comprising a surface which is shorter than the length of the base, at least one longitudinal through opening being disposed in at least one of the base and the main protrusion, wherein the longitudinal protrusion comprises an external shape which is complementary to and adapted to fit within the longitudinal recess when the brick material building element is fitted to another brick material building element. The method comprises arranging at least two brick material building elements near each other and connecting the at least two brick material building elements using at least one of a mortar, a cement and a concrete.

The method may further comprise forming at least one of a cases for a shutter, a roller shutter, lintels, a pilaster, a wall, a floor and a ceiling. The arranging may further comprise arranging at least one element adjacent another element to form a single layer structure. The method may further comprise at least one of attaching and incorporating an insulation material into the single layer structure. The arranging may further comprise arranging at least one element adjacent opposite another element to form a double layer structure. The method may further comprise at least one of attaching and incorporating an insulation material into the double layer structure. The method may further comprise forming a structure which has a high degree of earthquake resistance. The method may further comprise incorporating at least one reinforcing member into the mortar, the cement or the concrete.

The invention may be used in a variety of structures including the following three basic building types:

As a panel which is formed with one layer for interior separating walls, for exterior walls, or for ceilings. The type of structure would of course depend on the quantity and/or type of concrete mortar and on the quantity and/or type of reinforcing iron applied.

As a double layer panel which may be useful for load bearing interior and exterior walls, which may be insulated or non-insulated.

As sandwich type panels of various nature and design. These may be obtained by joining single layer panels, or by placing intermediate insulation layers into and/or between a double layer panel.

Based on these three basic configurations, up to six different basic panel types can be obtained, and up to twelve different types of panels.

Furthermore, it is possible to produce the following structures with the element:

Cases for shutters (roller or lamellae).

Inserts of all types for mounting fittings.

Recesses for appliances.

Pilasters, load bearing beams, and lintels.

Using the proposed system the following advantages can thus be obtained:

Standardized production of wall or ceiling panels.

Obtaining heavily reinforced cross-sections of concrete mortar inside the recesses obtained owing to the joining of the elements made from brick material, characteristics most important in seismic zones.

Installing, or inserting respectively, conduits inside the openings obtained by joining the elements made from brick material, where sufficient cross-section areas of cement mortar remain.

Obtaining joints between panels completely integrated with reinforcing iron and cement mortar.

Realizing completely homogeneous load bearing structures built up using only one sole basic element type.

Reducing manufacturing time of the panels prefabricated in the factory owing to the dimensions chosen for the basic element.

The elements made from brick material according to the present invention can be assembled without any special equipment or machinery being required other than the normal equipment applied in prefabrication operations.

The system is competitive with respect to cost compared to the traditional building methods owing to lower cost, and above all, owing to the reduction in building time.

Using the invention, it is even possible to build a complete structure of a housing unit of about 800 $m^3$ within just ten days.

The development of the inventive element also has created a base to elaborate a projecting method proper with all architectural building procedure details, from the basement to the roof, including finishes. This is achieved without limiting to specific types of building styles, which in most cases is implied if known prefab methods are used.

All the structures are interlocked in a horizontal direction as well as in a vertical direction and can also be applied as substitutes for traditional reinforced concrete structures.

BRIEF DESCRIPTION OF THE DRAWINGS

The present invention is further described in the detailed description which follows, in reference to the noted drawings by way of non-limiting examples of embodiments of the present invention, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
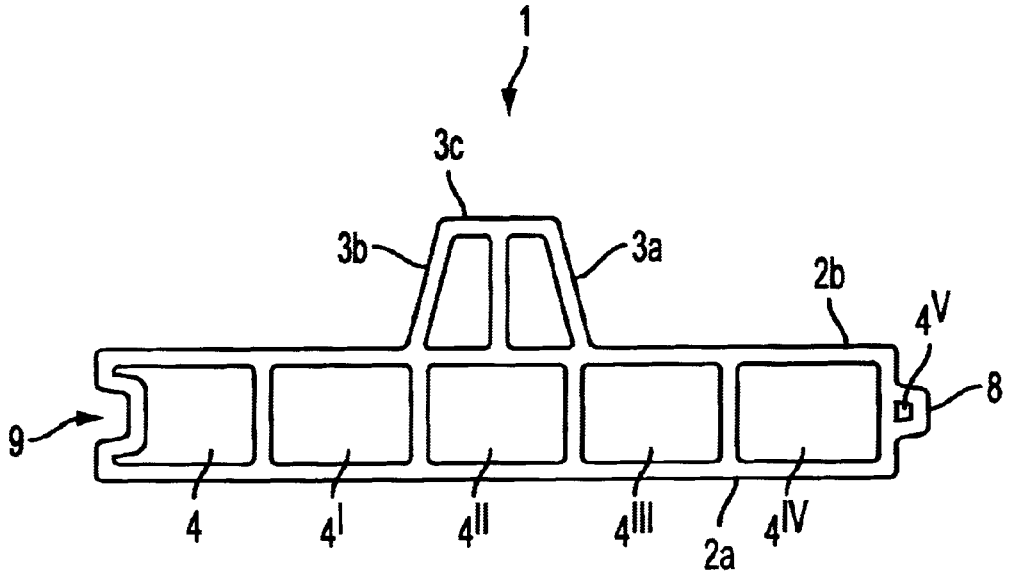
FIG. 1 shows, when viewed in the direction of its length, a side view of the element made from brick material and illustrates the longitudinal openings in a cross-section.

FIG. 1 shows a side view of the element 1 made which is preferably made from brick material, i.e., any material typically used to make bricks. However, any material may be used, conventional or otherwise, provided it is fit for its intended purpose. The element 1 is a T-shaped structure that includes a base portion 2 which has a plurality of, e.g., 5, longitudinal base openings 4–4$^{IV}$. The openings 4–4$^{IV}$ are through openings and extend the entire length L of the element 1. These openings 4–4$^{IV}$ may have any convenient shape and may vary in number without departing from the scope of the invention. However, it is preferred that they have the shape and number shown in the figure. The base portion also has a left side which is formed with a longitudinal recess 9 and a right side which is formed with a longitudinal protrusion 8. The design of the recess 9 and protrusion 8 is such that the protrusion of another element fits into the recess 9 of the element 1 shown and vice versa. The base also has an external surface side 2*a* and an internal surface side 2*b* which is substantially parallel to the external surface side 2*a*. A longitudinal main protrusion 3 extends from the internal surface side 2*b* of the base portion. The protrusion 3 also includes a plurality of through openings, e.g., two openings 5 and 5'. These openings 5 and 5' may have any convenient shape and may vary in number without leaving the scope of the invention. However, it is preferred that they have a trapezoidal shapes 18 and 18' and that two such openings 5 and 5' are utilized.

The protrusion 8 also includes a through opening, e.g., one opening 4$^{V}$. This opening 4$^{V}$ may have any convenient shape and may also be more than one opening without leaving the scope of the invention. However, it is preferred that the opening 4$^{V}$ have the shape shown in the figure.

It should be noted that the number, the shape and the arrangement of such openings 4–4$^{V}$, 5, 5', 18 and 18' can vary depending on production requirements for the element made from brick material and/or requirements resulting from static calculations for the element 1. Obviously the outer contour of the element 1 can remain unchanged, and the openings should all extend longitudinally through the full length L of the element 1.

The protrusion 3 is positioned in the approximate center of the base portion 2 and has two sides 3*a* and 3*b* which are inclined towards the interior surface 2*b* as well as an inner side 3*c* which is approximately parallel to the sides 2*a* and 2*b*. A distance between the surface 3*c* and surface 2*b* is defined by the value "n". The angle of inclination of the sides 3*a* and 3*b* of the protrusion 3 may range between approximately 10° and approximately 45°. However, the invention contemplates other angles as well.

Figure 3:
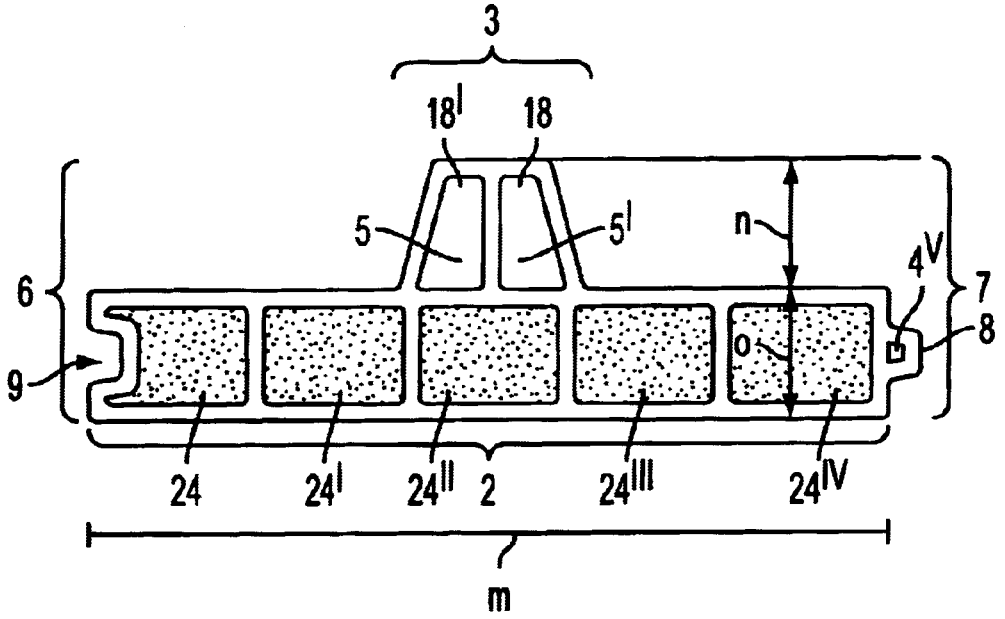
FIG. 3 shows the same view as the one in FIG. 1, but with many of the longitudinal openings filled with an insulating material.

With reference to FIG. 3, it can be seen that the element 1 has a left outer longitudinal side 6 and a right outer longitudinal side 7. The longitudinal protrusion 8 is shown on the right side 7 whereas the other side 6 is provided with the longitudinal recess 9. The element 1 comprises a width W which is defined between the side of the base portion which has the recess 9 and the side of the base portion which has the protrusion 8. As can be seen in FIG. 3, insulating material 24–24$^{IV}$ may be provided inside each of the openings 4–4$^{IV}$ in order to improve the insulating ability of the element 1. The invention contemplates that this insulation may be added to the elements 1 initially (i.e, before the elements are joined together to form a panel structure) or after a plurality of elements 1 are joined together to form a panel structure using, e.g., a insulation pressure blowing/filling process.

Figure 2:
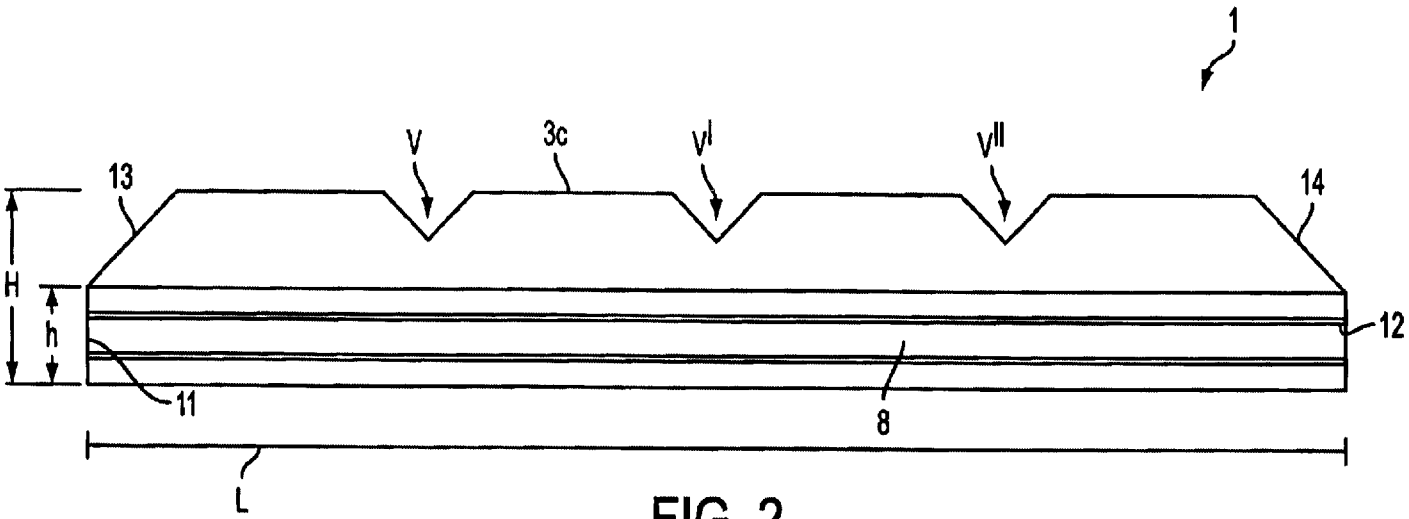
FIG. 2 shows a side view of the element when viewed from a direction perpendicular to the length of the element.

With reference to FIG. 2, it can be seen that element 1 has a length L which is defined between the left side 11 and the right side 12. This figure also shows that the main protrusion 3 is formed with V-shaped notches V–V". The left side 11 also includes an inclined portion 13 of the protrusion which tapers from surface 3*c* to surface 2*b*. Similarly, the right side 12 also includes an inclined portion 14 of the protrusion 3 which tapers from surface 3*c* to surface 2*b*. The element also has an overall thickness defined by a height H.

Figure 4:
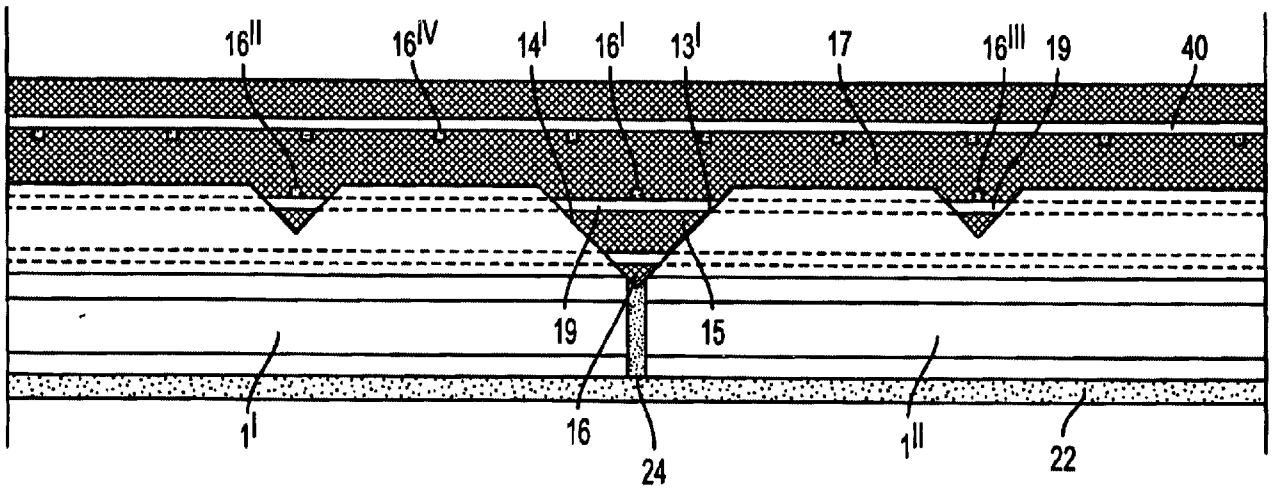
FIG. 4 shows one way that two elements may be joined to form a single layer panel structure. Two elements are shown arranged side by side in the direction of their lengths and are joined together using a combination of cement and/or mortar and various reinforcing rods, bars or irons.

With reference to FIG. 4, there can be seen one reason for the provision of the inclined zones 13 and 14 on the sides 11 and 12 of the element 1, i.e., it allows for the connection of two inventive elements 1' and 1" using reinforcements 16 and 16'. The elements 1' and 1" arranged lengthwise and adjacent one another form a triangular recess 15 which is tapered towards the base 2. In this triangular recess zone 15, transverse reinforcing rods 16 and 16' may be placed, which after integration with cement mortar 17, lend resistance to the panel assembled from the inventive elements 1' and 1". V-shaped notch zones are similarly adapted to receive transverse reinforcing rods 16" and 16''', which after integration with cement mortar 17, also lend resistance to the panel assembled from the inventive elements 1' and 1".

FIG. 4 illustrates one possible structure made from elements 1' and 1". In this single layer panel structure, element 1' is arranged adjacent element 1". Separating the element 1' from element 1" is arranged an insulating material 24. Longitudinal reinforcing members 19 and 19' are installed into one or each opening 5 and 5' of the protrusion 3 such that these reinforcing members 19 and 19' connect the elements 1' and 1". In the triangular area defined by the inclined surfaces 13' and 14', the reinforcing members 19 and 19' can be connected to transverse reinforcing members 16 and 16', with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16''' in the areas of the V-shaped notches of the elements 1, 1'. This panel structure also uses additional longitudinal reinforcing members 40 which are connected to additional transverse reinforcing members $\mathbf{16}^{IV}$ (10 additional transverse reinforcing members $\mathbf{16}^{IV}$ are shown). A cement mortar 17 is poured above the elements 1, 1' and the reinforcing systems in order to form a single layer panel structure when cured. Finally, an external layer 22 is applied to the surfaces 2*a* of the elements 1, 1'. This surface 22 may be, e.g., a mortar or plaster layer.

It should be noted at this point that the protrusion 8 and the longitudinal recess 9 of the element 1, which complement each other in shape, are formed with tapered sides as shown in FIGS. 1, 3, 5, 6, etc. However, the particular complementary shapes need not be made with particular precision, i.e., the joint formed between the protrusion 8 and recess 9 need not be without play, since any play can be taken up via the reinforcements 19 and the concrete or cement mortar 17.

It should also be noted that the inclination angle of the inclined zones 13 and 14 with respect to the surfaces 2*a* and 2*b* of the base 2 of the element 1 is preferably in the range of between approximately 30° and approximately 75°.

Figure 5:
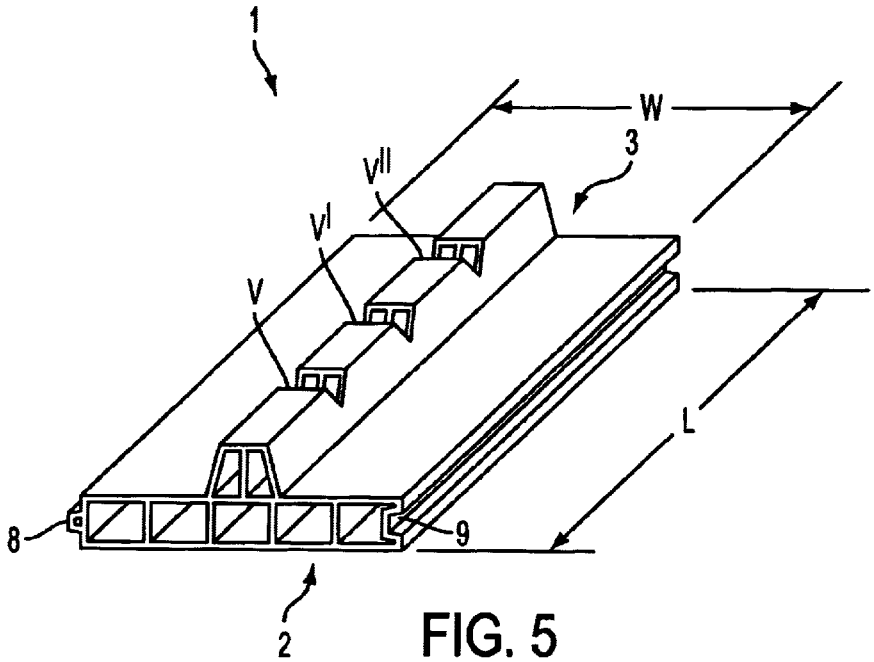
FIG. 5 shows an perspective view of a single element made from brick material.

With reference to FIG. 5, it can be seen that the protrusion 3 is provided with at least three V-shaped recesses V–V" with the depth of these notches being equal to approximately ¼ of the height H (see FIG. 2) of the element 1 in order to permit insertion of transverse reinforcing rods 16'–16''' (see e.g., FIG. 4), which after integration with concrete mortar 17 increases the load bearing capacity of the panel formed with elements 1. Furthermore, the cement mortar 17 penetrates into the openings 5, 5' via the triangular openings V–V" and 15 and thus improves cohesion between the elements 1 and the concrete mortar 17 itself.

The length L of the element 1 may be made in the range of between approximately 50 cm to approximately 100 cm, with the preferred ideal length ranging between approximately 74 cm to approximately 94 cm. The width W of the element 1 may range between approximately 30 cm to approximately 60 cm, with the preferred ideal width W ranging between approximately 42 cm to approximately 60 cm. The height H of the element 1 may range between approximately 10 cm to approximately 28 cm, with the preferred ideal height H being approximately 14 cm.

With these dimensions many types of panels can be prefabricated as mentioned herein.

With reference to FIG. 3, it can be seen that the thickness "o" of the base portion 2 and the thickness "n" of the protrusion 3 of the element 1 may be made so that they are approximately equal to ½ of the height H of the element 1 according to the following relation:

$$o \cong n \cong H/2$$

Additionally, the element 1 may be formed such that the base portion 2 of the element 1 includes openings $\mathbf{4}$–$\mathbf{4}^{IV}$ which are filled with a suitable insulating material $\mathbf{24}$–$\mathbf{24}^{IV}$ for improving the K value of the element 1. The insulating material $\mathbf{24}$–$\mathbf{24}^{IV}$ preferably extends longitudinally through the cross-sectional area throughout the full length of the element 1. Additionally, such insulation material 24 may also be placed into openings 5, 5' of the protrusion 3 (not shown).

Figure 6:
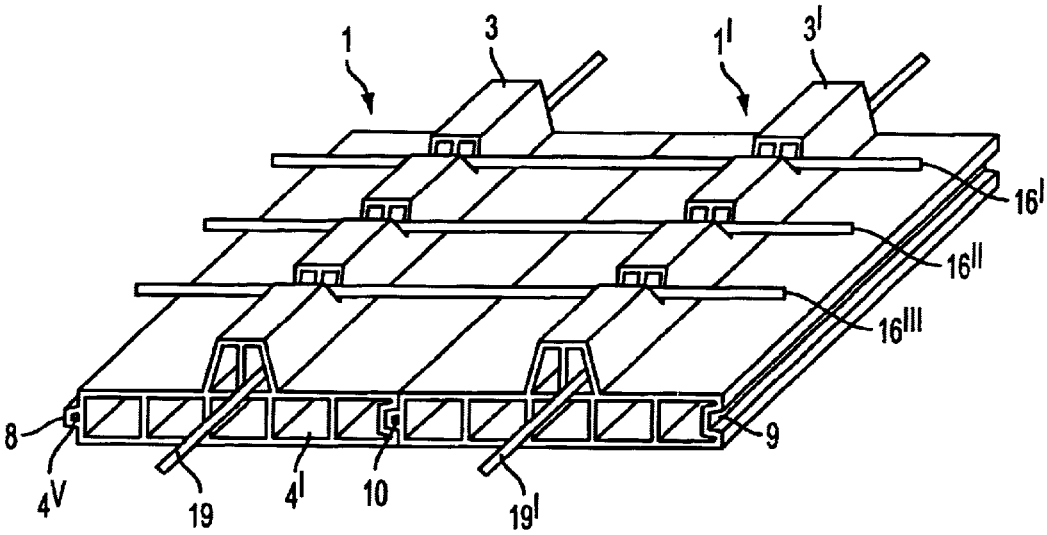
FIG. 6 shows a perspective view of two elements and how such elements may be joined along the length of their sides and how some of the reinforcing may be arranged and/or used in connection with the two elements.

With reference to FIG. 6, it can be seen how two elements 1 and 1' can be arranged adjacent one another prior to being connected by the mortar 17. It can be seen that the protrusion 8 of element 1' is inserted into recess 9 of element 1' so as to form a joint 10 therebetween. Longitudinal reinforcing members 19 and 19' are then inserted into one opening 5' of each protrusion 3 and 3'. Thereafter, transverse reinforcing members 16'–16''' are positioned within aligned V-shaped notches. The members 19, 19' may then be connected to members 16'–16''' via welding, wire, or other convenient connection mechanisms, whether conventional or otherwise. The panel structure may then be prepared to receive mortar 17 which serves to form a panel structure of the type shown in, e.g., FIG. 4. It should be understood that the integration with concrete mortar 17 increases the load bearing capacity of the panel formed with elements 1 and 1'. Furthermore, the cement mortar 17 penetrates into the openings 5, 5' via the triangular openings V–V" and 15 and thus improves cohesion between the elements 1 and the concrete mortar 17 itself.

FIGS. 7–16 show various panel structures which can be made using the element 1 of the invention. However, this is done by way of examples and the invention is not limited to any particular panel structure which is formed using the elements 1.

Figure 7:
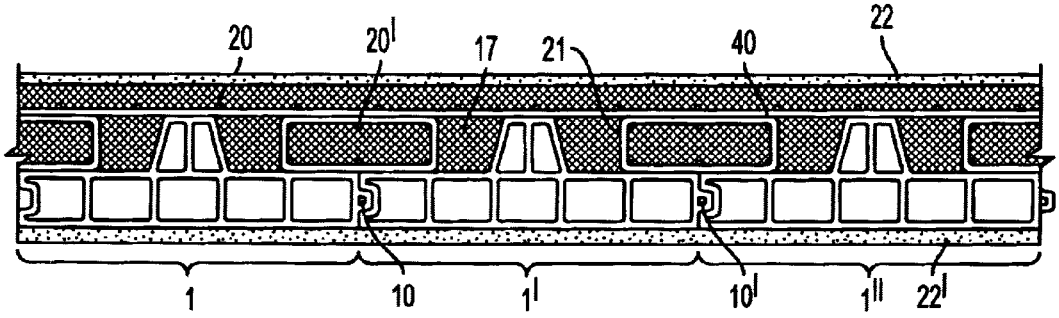
FIG. 7 shows a cross-sectional view of three elements made from brick material which are used to form a single layer panel. The panel utilizes various reinforcing systems including crossing bars and reinforcing grids and/or hoops, as well as cement and/or mortar. Such a design may be used as an interior or exterior wall, or as a ceiling.

FIG. 7 illustrates a possible structure in which three elements 1–1" are shown. In this single layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1".

The panel structure of FIG. 7 is then finished using additional longitudinal reinforcing members 20 (13 being shown) which are connected to additional transverse reinforcing members 40, and using other additional longitudinal reinforcing members 20' (6 being shown in each grid 21) which are connected to reinforcing grids 21. A cement mortar 17 is then poured above the elements 1–1" and the reinforcing systems 16, 19, 20, 20', 21 and 40, in order to form a single layer panel structure when the mortar is cured. Finally, an internal finish layer 22' is applied to the surfaces 2*a* of the elements 1–1", and an external layer 22 is applied to the cured mortar 17. The surfaces 22 and 22' may be any desired covering surface layer, e.g., a mortar layer, a plaster layer, etc.

Although not shown, in a manner similar to that shown in FIG. 4, the structure shown in FIG. 7 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16''' in the areas of the V-shaped notches of the elements 1, 1'.

Figure 8:
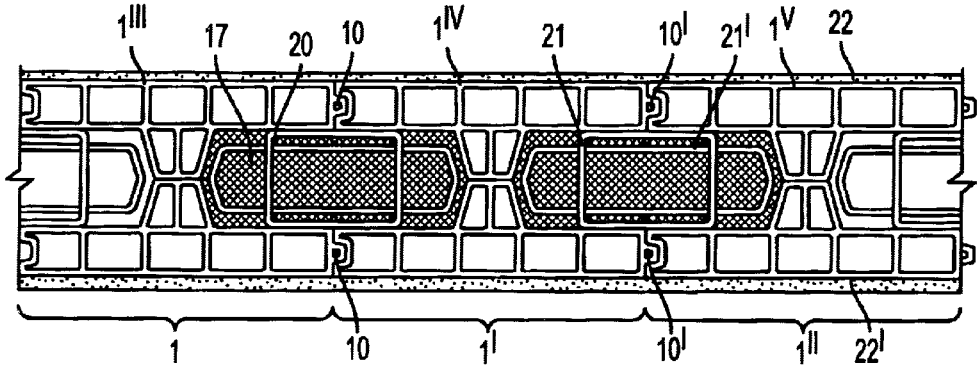
FIG. 8 shows a cross-sectional view of six elements made from brick material which are used to form a double layer panel from superimposed elements. The panel utilizes various reinforcing systems including reinforcing bars, grids and/or hoops, as well as cement and/or mortar. Such a design may be used as an exterior wall of a building.

FIG. 8 illustrates another possible structure in which six elements $\mathbf{1}$–$\mathbf{1}^{V}$ are shown. In this double layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1". Superimposed above the three elements 1–1" are arranged elements 1"'–1$^{V}$. Thus, element 1"' is arranged adjacent element 1$^{IV}$ and element 1$^{IV}$ is arranged adjacent element 1$^{V}$. These three elements 1"'–1$^{V}$ are also arranged to form a first joint 10 between the protrusion 8 of element 1"' and the recess 9 of element 1$^{IV}$. A second joint 10' is formed between the protrusion 8 of element 1$^{IV}$ and the recess 9 of element 1$^{V}$.

The panel structure of FIG. 8 is then finished by interposing additional reinforcing grids 21 and 21' which are connected to additional longitudinal reinforcing members 20 (6 are shown in each grid 21). A cement mortar 17 is then poured into the spaces between the elements 1–1$^{V}$ and the reinforcing systems 16, 19, 20, 20', 21 and 21', in order to form a double layer panel structure when the mortar 17 is cured. Finally, an internal finish layer 22' is applied to the surfaces 2*a* of the elements 1–1", and an external layer 22 is applied to the surfaces 2*a* of the elements 1"'–1$^{V}$. The surfaces 22 and 22' may be any desired covering surface layer, e.g., a mortar layer, a plaster layer, etc.

Although not shown, in a manner similar to that shown in FIG. 4, the structure shown in FIG. 8 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16'" in the areas of the V-shaped notches of the elements 1, 1'.

Figure 9:
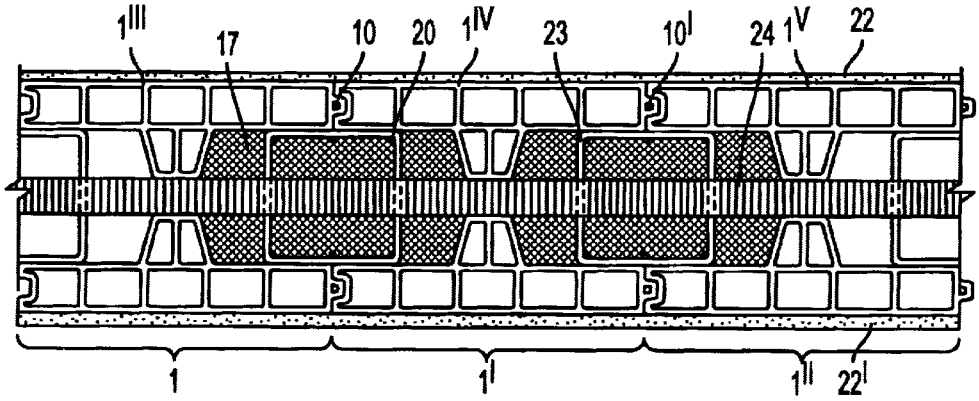
FIG. 9 shows a cross-sectional view of six elements made from brick material which are used to form a double layer insulated panel from superimposed elements. The insulated panel utilizes various reinforcing systems including reinforcing bars, grids and/or hoops, as well as cement and/or mortar. Moreover, a layer of insulating material is arranged between the superimposed elements. Such a design may be used as a sandwich type exterior wall of a building.

FIG. 9 illustrates another possible structure in which six elements 1–1$^{V}$ are shown. In this double layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1". Superimposed above the three elements 1–1" are arranged elements 1"'–1$^{V}$. Thus, element 1"' is arranged adjacent element 1$^{IV}$ and element 1$^{IV}$ is arranged adjacent element 1$^{V}$. These three elements 1"'–1$^{V}$ are also arranged to form a first joint 10 between the protrusion 8 of element 1"' and the recess 9 of element 1$^{IV}$. A second joint 10' is formed between the protrusion 8 of element 1$^{IV}$ and the recess 9 of element 1$^{V}$.

The panel structure of FIG. 9 is then finished by interposing an insulating material 24 in the form of a insulating foam panel, as well as additional reinforcing and connecting grids 23 which are connected to additional longitudinal reinforcing members 20 (6 are shown in each grid 23). A cement mortar 17 is then poured into the spaces between the elements 1–1$^{V}$ and the insulating material 24 so as to encapsulate the reinforcing systems 16, 19, 20, and 23, in order to form a double layer insulated panel structure when the mortar 17 is cured. Finally, an internal finishing layer 22' is applied to the surfaces 2*a* of the elements 1–1", and an external layer 22 is applied to the surfaces 2*a* of the elements 1"'–1$^{V}$. The surfaces 22 and 22' may be any desired covering surface layer, e.g., a mortar layer, a plaster layer, etc. It should be noted that in this design, reinforcing grids 23 act to connect the panels formed by opposing elements by virtue of their passing through the insulating layer 24.

Although not shown, in a manner similar to that shown in FIG. 4, the structure shown in FIG. 9 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16'" in the areas of the V-shaped notches of the elements 1, 1'.

Figure 10:
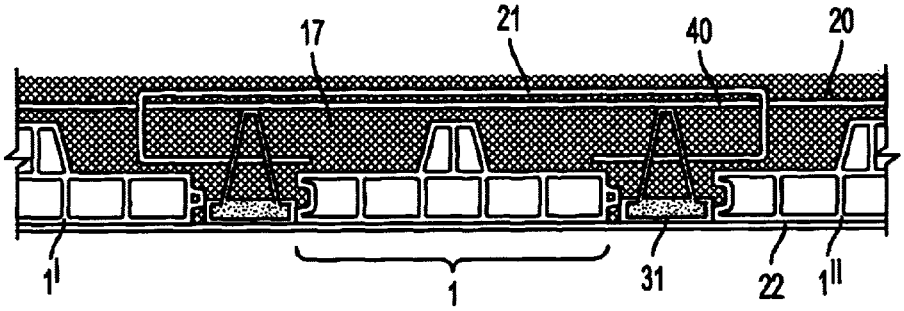
FIG. 10 shows a cross-sectional view of a single layer panel. The panel utilizes various reinforcing systems including crossing bars and reinforcing grids and/or hoops, as well as cement and/or mortar. This design also includes interposed conventional prefab beams arranged between the elements.

FIG. 10 illustrates another possible structure in which three elements 1–1" are shown. In this single layer panel structure, element 1 is arranged adjacent elements 1' and 1". The three elements 1–1" are arranged such that a first load bearing beam is arranged between the protrusion 8 of element 1' and the recess 9 of element 1. A second load bearing beam 31' is arranged between the protrusion 8 of element 1 and the recess 9 of element 1".

The panel structure of FIG. 10 is then finished using additional longitudinal reinforcing members 20 (11 being shown) which are connected to additional transverse reinforcing members 40, and using reinforcing grids 21 (1 being shown) which are also connected to additional longitudinal rods 20. A cement mortar 17 is then poured above the elements 1–1" and the reinforcing systems 16, 19, 20, 21 and 40, in order to form a single layer panel structure when the mortar is cured. Finally, an internal finish layer 22 is applied to the surfaces 2*a* of the elements 1–1". The surface 22 may be any desired covering surface layer, e.g., a mortar layer, a plaster layer, etc.

Although not shown, in a manner similar to that shown in FIG. 4, the structure shown in FIG. 10 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16'" in the areas of the V-shaped notches of the elements 1, 1'.

Figure 11:
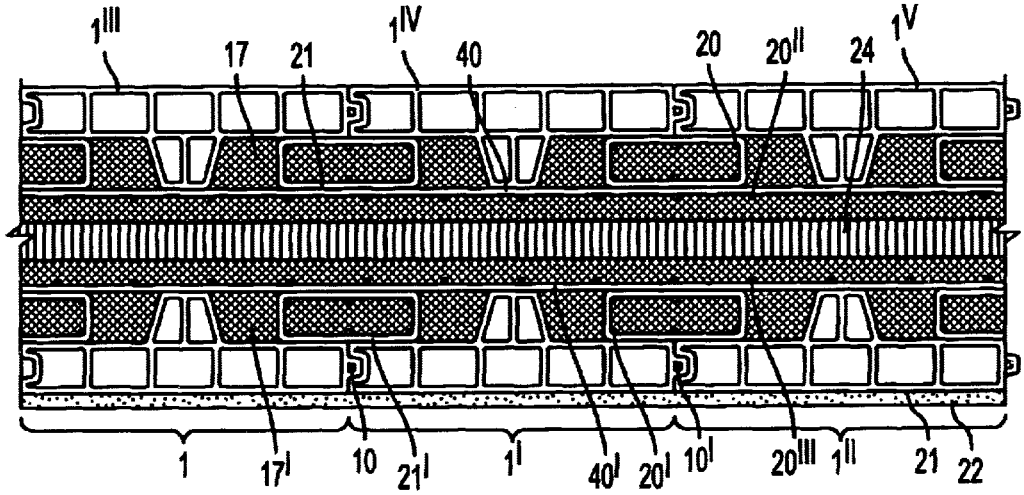
FIG. 11 shows a cross-sectional view of six elements made from brick material which are used to form another double layer insulated panel from superimposed elements. This design represents a thicker version of the structure shown in FIG. 9. The insulated panel utilizes various reinforcing systems including reinforcing bars, grids and/or hoops, as well as cement and/or mortar. Moreover, a layer of insulating material is arranged between the superimposed elements. Such a design may be used as a sandwich type exterior wall of a building. The insulating material layer may also be in the form of thermal insulation of variable thickness that is interposed for improving the K value of the wall and for interrupting possible cold spots.

FIG. 11 illustrates another possible structure in which six elements 1–1$^{V}$ are shown. In this double layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1". Superimposed above the three elements 1–1" are arranged elements 1"'–1$^{V}$. Thus, element 1"' is arranged adjacent element 1$^{IV}$ and element 1$^{IV}$ is arranged adjacent element 1$^{V}$. These three elements 1"'-1 $^{V}$are also arranged to form a first joint 10 between the protrusion 8 of element 1"' and the recess 9 of element 1$^{IV}$. A second joint 10' is formed between the protrusion 8 of element 1$^{IV}$ and the recess 9 of element 1$^{V}$.

The panel structure of FIG. 11 is then finished by interposing an insulating material 24 in the form of a insulating foam panel, as well as additional reinforcing and connecting grids 21 and 21' which are connected to additional longitudinal reinforcing members 20 and 20' (6 are shown in each grid 21, and 13 of each of 20" and 20"' are shown connected to each transverse rod 40 and 40'). A cement mortar 17 and 17' is then poured into the spaces between the elements 1–1$^{V}$ and the insulating material 24 so as to encapsulate the reinforcing systems 16, 19, 20, 20', 21, 21' and 40, in order to form a double layer insulated panel structure when the mortar 17 and 17' is cured. Finally, an internal finishing layer 22 is applied to the surfaces 2*a* of the elements 1–1". The surfaces 22 may be any desired covering surface layer, e.g., a mortar layer, a plaster layer, etc. It should be noted that in this design, reinforcing does not act to connect the panels formed by opposing elements since they do not pass through the insulating layer 24.

Although not shown, in a manner similar to that shown in FIG. 4, the structure shown in FIG. 11 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16"' in the areas of the V-shaped notches of the elements 1, 1'.

Figure 12:
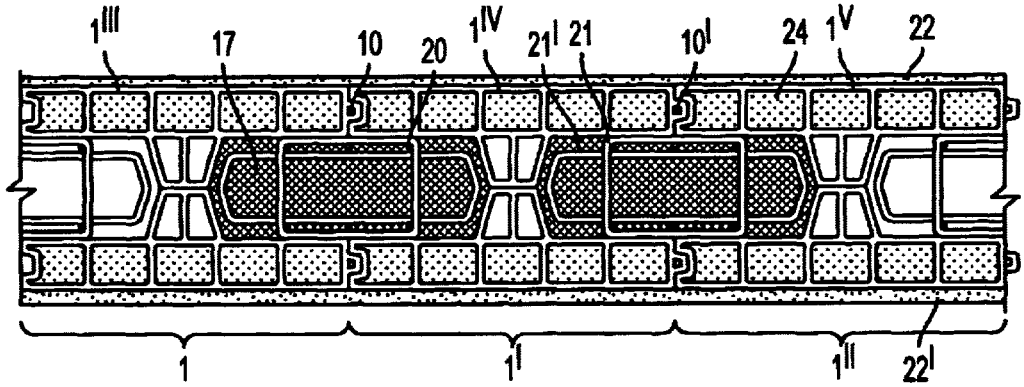
FIG. 12 shows a cross-sectional view of six elements made from brick material similar to the structure shown in the FIG. 8, but with insulating material placed inside the base openings of the elements.

FIG. 12 illustrates another possible structure in which six elements 1–1$^{V}$ are shown. In this double layer panel structure, element 1 has its openings 24 insulated and is arranged adjacent element 1'. Similarly, insulated element 1' is arranged adjacent insulated element 1". The three insulated elements 1–1" are arranged to form a first joint 10 between the protrusion 8 of element 1 and the recess 9 of element 1'. A second joint 10' is formed between the protrusion 8 of element 1' and the recess 9 of element 1". Superimposed above the three elements 1–1" are arranged insulated elements 1"'–1$^{V}$. Thus, insulated element 1"' is arranged adjacent insulated element 1$^{IV}$ and insulated element 1$^{IV}$ is arranged adjacent insulated element 1$^{V}$. These three insulated elements 1"'–1$^{V}$ are also arranged to form a first joint 10 between the protrusion 8 of element 1"' and the recess 9 of element 1$^{IV}$. A second joint 10' is formed between the protrusion 8 of insulated element 1$^{IV}$ and the recess 9 of insulated element 1$^{V}$.

The panel structure of FIG. 12 is then finished by interposing additional reinforcing grids 21 and 21' which are connected to additional longitudinal reinforcing members 20 (6 are shown in each grid 21). A cement mortar 17 is then poured into the spaces between the elements 1–1$^{V}$ and the reinforcing systems 16, 19, 20, and 21, in order to form a double layer panel structure when the mortar 17 is cured. Finally, an internal finishing layer 22' is applied to the surfaces 2*a* of the elements 1–1", and an external layer 22 is applied to the surfaces 2*a* of the elements 1"'–1$^{V}$. The surfaces 22 and 22' may be any desired covering surface layer, e.g., a mortar layer, a plaster layer, etc.

Although not shown, in a manner similar to that shown in FIG. 4, the structure shown in FIG. 12 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16"' in the areas of the V-shaped notches of the elements 1, 1'.

Figure 13:
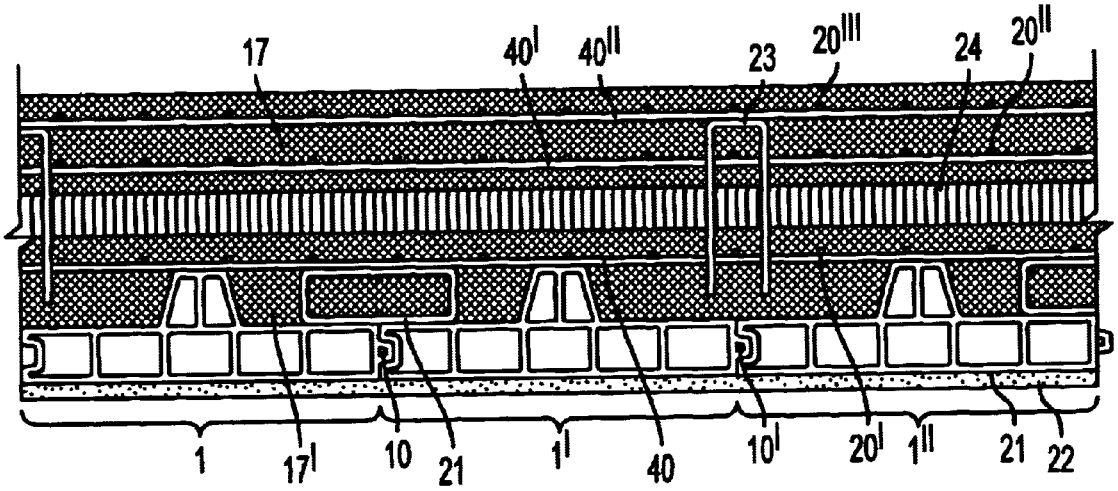
FIG. 13 shows a cross-sectional view of another single layer panel structure design (similar to that shown in the FIG. 7). However, this design represents a mono-lithic reinforced concrete panel which includes an interposed insulation material and additional reinforcing systems.

FIG. 13 illustrates another possible structure in which three elements 1–1" are shown. In this single layer insulated panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1".

The panel structure of FIG. 13 then uses various additional transverse reinforcing members 40, 40' and 40" which are connected to additional longitudinal reinforcing members 20, 20', 20" and 20"', some of which are connected to reinforcing grids 21. An insulating panel 24 is arranged offset from the elements 1–1" and a cement mortar 17 and 17' is then poured into the spaces between the insulation 24 and the elements 1–1" and the reinforcing systems 16, 19, 20, 21 and 40 and between insulation and outer surface of mortar 17, in order to form a single layer panel structure when the mortar 17 and 17' is cured. Then an internal finishing layer 22 is applied to the surfaces 2*a* of the elements 1–1". The surfaces 22 may be any desired covering surface layer, e.g., a mortar layer, a plaster layer, etc. It should be noted that in this design, reinforcing grids 23 act to connect the panels formed by opposing elements by virtue of their passing through the insulating layer 24 and being encapsulated by the mortar 17 and 17'.

Although not shown, in a manner similar to that shown in FIG. 4, the structure shown in FIG. 13 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16"' in the areas of the V-shaped notches of the elements 1, 1'.

Figure 14:
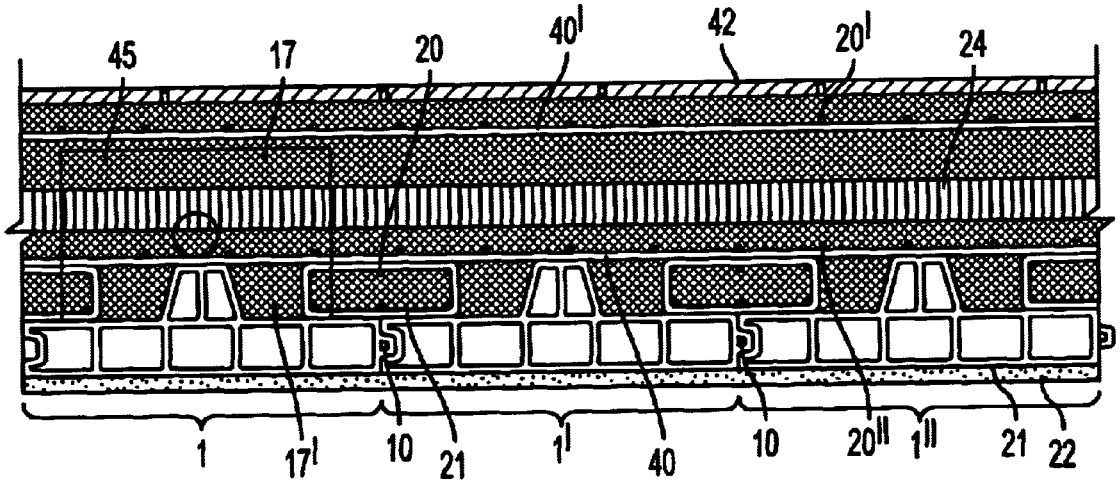
FIG. 14 shows a cross-sectional view of still another single layer panel structure design. This design represents a monolithic reinforced concrete panel with visible face bricks and an interposed insulation material.

FIG. 14 illustrates another possible structure in which three elements 1–1" are shown. In this single layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1".

The panel structure of FIG. 14 is then finished using additional longitudinal reinforcing members 20' and 20" (13 of each being shown) which are connected to additional transverse reinforcing members 40 and 40', and using other additional longitudinal reinforcing members 20 (6 being shown in each grid 21) which are connected to reinforcing grids 21. An insulating panel 24 is arranged offset from the elements 1–1" and a cement mortar 17' is then poured into the spaces between the insulation 24 and the elements 1–1" and the reinforcing systems 16, 19, 20–20", 21, 40 and 40', in order to form a single layer panel structure when the mortar 17' is cured. Finally, an outer mortar layer 17, along with its reinforcements 20 and 40 etc, is applied against the insulation 24. Then an internal finish layer 22 is applied to the surfaces 2*a* of the elements 1–1", and an external layer 42 is applied to the cured mortar 17. The surfaces 22 may be any desired covering surface layer, e.g., a mortar layer, a plaster layer, etc. However, the surface 42 in this design is preferably a brick face surface layer. It should be noted that in this design, reinforcing connections 45 act to connect the panels formed by opposing elements by virtue of their passing through the insulating layer 24 and being encapsulated by the mortar 17 and 17'.

Although not shown, in a manner similar to that shown in FIG. 4, the structure shown in FIG. 14 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16''' in the areas of the V-shaped notches of the elements 1, 1'.

Figure 15:
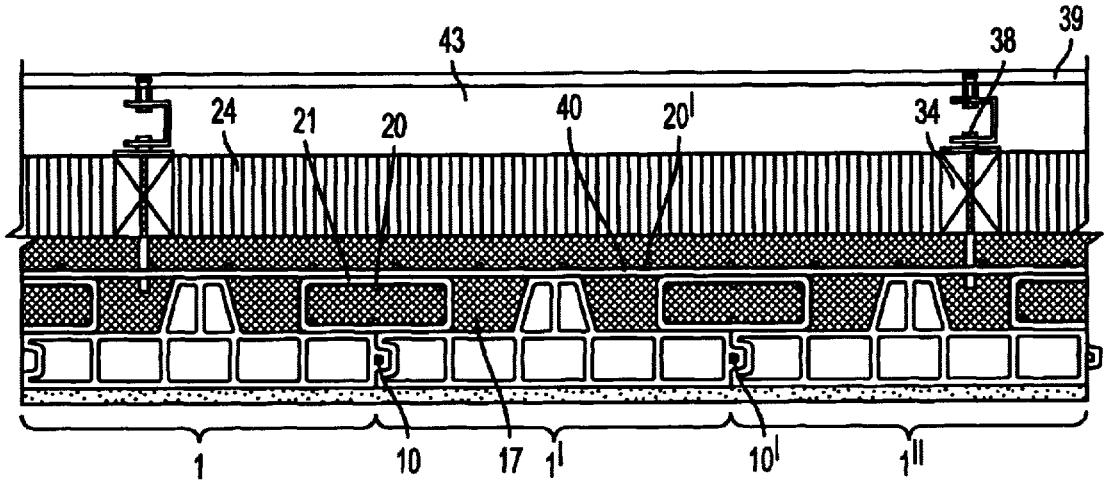
FIG. 15 shows a cross-sectional view of still another single layer panel structure design which may be used in an exterior wall. This design uses an insulating material arranged between the elements and a ventilated curtain facade with wooden slats interposed between insulating panels and with special metal support elements which may be made from Inox (corrosion resistant) steel being used to provide an air space between the insulating material and the ventilated curtain.

FIG. 15 illustrates another possible structure in which three elements 1–1" are shown. In this single layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1".

The panel structure of FIG. 15 is then finished using additional longitudinal reinforcing members 20' (13 being shown) which are connected to additional transverse reinforcing members 40, and using other additional longitudinal reinforcing members 20 (6 being shown in each grid 21) which are connected to reinforcing grids 21. An insulating panel 24 is arranged offset from the elements 1–1" and a cement mortar 17 is then poured into the spaces between the insulation 24 and the elements 1–1" and the reinforcing systems 16, 19, 20, 20', 21, and 40, in order to form a single layer panel structure when the mortar 17 is cured. Interposed between the insulation panels 24 are arranged wooden slats 34 to which the separating/connecting assemblies are fixed. Finally, an outer curtain layer 39 is mounted to the separating/connecting assemblies 39. Then an internal finishing layer 22 is applied to the surfaces 2*a* of the elements 1–1". The surfaces 22 may be any desired covering surface layer, e.g., a mortar layer, a plaster layer, etc. However, the surface 39 in this design is preferably a ventilating curtain facade. It should be noted that in this design, separating/connecting assemblies 38 act to connect the layer 39 to the mortar 17 by virtue of the assemblies 38 passing through the insulating layer 24 (via the wooden slats) and having a lower end which is encapsulated by the mortar 17.

Although not shown, in a manner similar to that shown in FIG. 4, the structure shown in FIG. 15 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16''' in the areas of the V-shaped notches of the elements 1, 1'.

Figure 16:
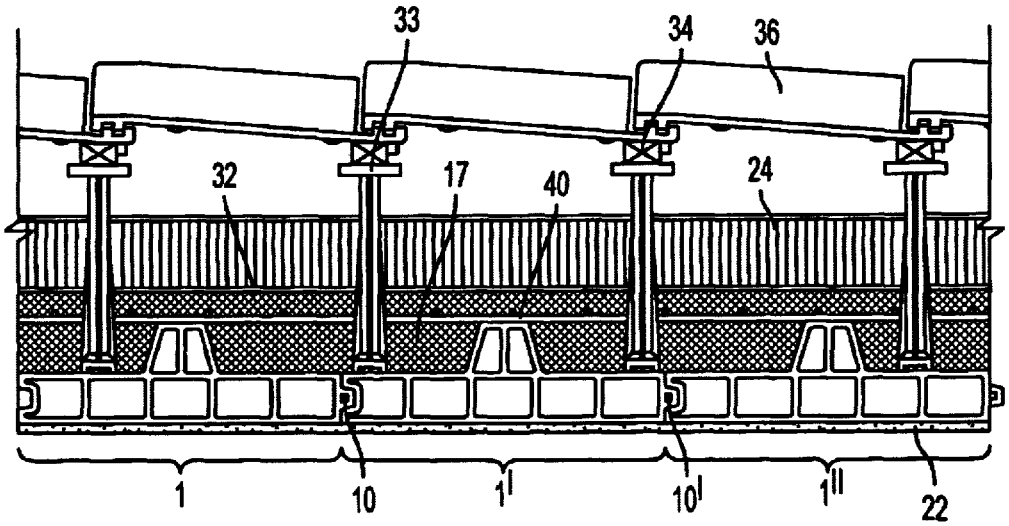
FIG. 16 shows a cross-sectional view of still another single layer panel structure design which may be used in a ceiling or roof structure. This design uses an insulating material arranged between the elements and tiles with support elements being used to provide an air space between the insulating material and the tiles.

FIG. 16 illustrates another possible structure in which three elements 1–1" are shown. In this single layer panel structure, element 1 is arranged adjacent element 1' and element 1' is arranged adjacent element 1". The three elements 1–1" are arranged to form a first joint 10 between the protrusion 8 of element 1 and the recess 9 of element 1'. A second joint 10' is formed between the protrusion 8 of element 1' and the recess 9 of element 1".

The panel structure of FIG. 16 is then finished using additional longitudinal reinforcing members 20 (11 being shown) which are connected to additional transverse reinforcing members 40. An insulating panel 24 is arranged offset from the elements 1–1". A vapor or humidity barrier 32 may also be used adjacent the insulation panel, and on only one or both sides of the panel. A cement mortar 17 is then poured into the spaces between the insulation 24 and the elements 1–1" and the reinforcing systems 16, 19, 20, 20', 21, and 40, in order to form a single layer panel structure when the mortar 17 is cured. Interposed between the insulation panels 24 are arranged hard plastic support members 33 which have attached thereto wooden slats 34. Finally, an outer tile layer 36 is mounted to the hard plastic support members 33 via the slats 34. Then an internal finish layer 22 is applied to the surfaces 2*a* of the elements 1–1". The surfaces 22 may be any desired covering surface layer, e.g., a mortar layer, a plaster layer, etc. However, the surface 36 in this design is preferably a plurality of tiles 36. It should be noted that in this design, hard plastic support members 33 and wooden slats 34 act to connect the layer 36 to the mortar 17 by virtue of the members 33 passing through the insulating layer 24 and having a lower end which is encapsulated by the mortar 17.

Although not shown, in a manner similar to that shown in FIG. 4, the structure shown in FIG. 16 may additionally include the connection system shown in FIG. 4. Thus, the longitudinal reinforcing members 19 may be installed into one or each opening 5 and 5' of each protrusion 3 and in the triangular areas defined by the inclined surfaces 13' and 14'. The reinforcing members 19 may be connected to transverse reinforcing members 16, with lower longitudinal reinforcing member 19 being connected to lower transverse reinforcing member 16 and with upper longitudinal reinforcing member 19' being connected to upper transverse reinforcing member 16'. The upper longitudinal reinforcing member 19' is also connected to additional transverse reinforcing members 16" and 16''' in the areas of the V-shaped notches of the elements 1, 1'.

Figure 17:
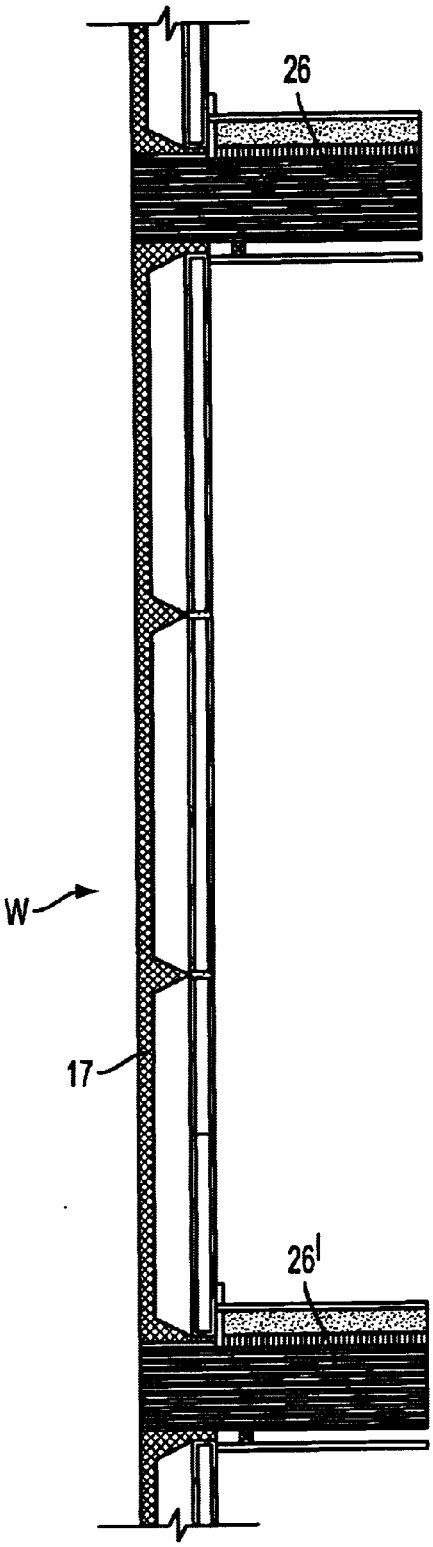
FIG. 17 is a cross-sectional view of a portion of a building using a single panel structure formed of the elements. The design uses a single layer panel wall structure in combination with a ceiling panels. Three elements are shown against the interior side and an exterior side is formed by the mortar. The facade cover has not yet been placed against the outside surface of the side wall structure.

FIG. 17 illustrates how the structure made in the manner of FIG. 4 or 10 may be used to form the vertical outer wall 27 of a building. It can be seen that the wall 27 supports floor/ceiling 26 with respect floor/ceiling 26'.

Figure 18:
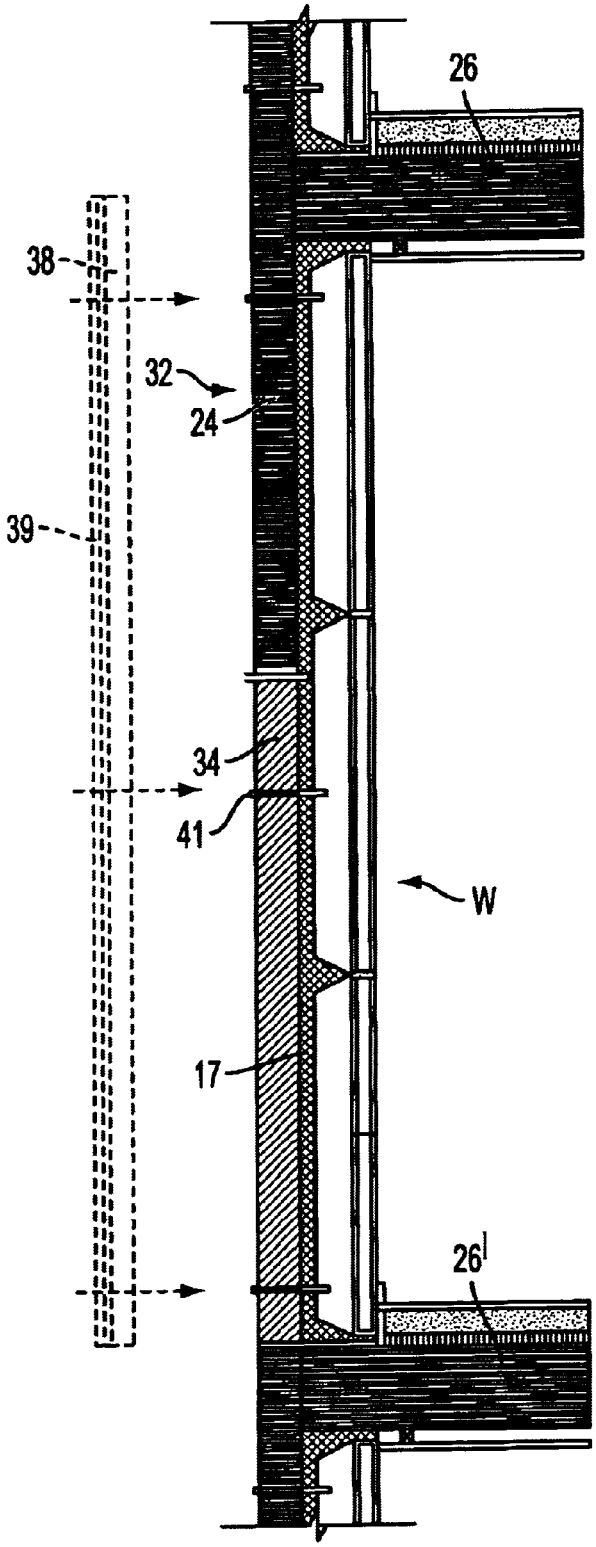
FIG. 18 shows the same arrangement as shown in FIG. 17, but with e.g., a ventilated curtain facade system being placed against the exterior surface.

FIG. 18 illustrates how the structure made in the manner of FIG. 15 may be used to form the vertical outer wall 27 of a building. It can be seen that the wall 27 supports floor/ceiling 26 with respect floor/ceiling 26'. Additional connecting members 41 may be used to connect wooden slats 34 to the mortar 17.

Figure 19:
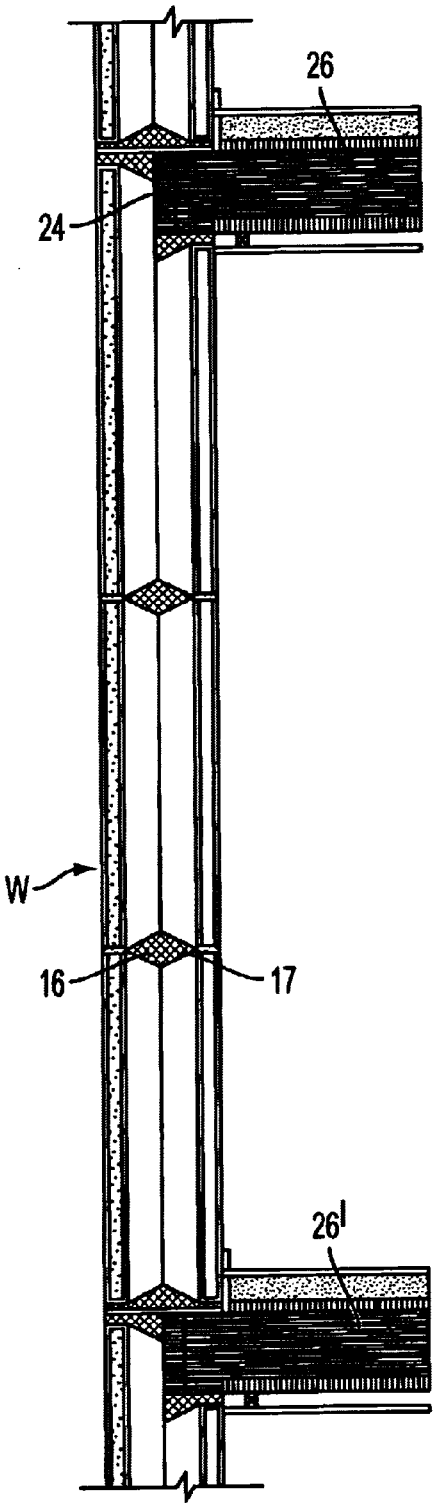
FIG. 19 shows a cross-sectional view of a portion of a building using a double panel structure formed of the elements. The side wall between the ceiling panels 26 and 26' may be similar to that shown in FIG. 8 or 12.

FIG. 19 illustrates how the structure made in the manner of FIG. 8 or 12 may be used to form the vertical outer wall W of a building. It can be seen that the wall W supports floor/ceiling 26 with respect to floor/ceiling 26'.

Figure 20:
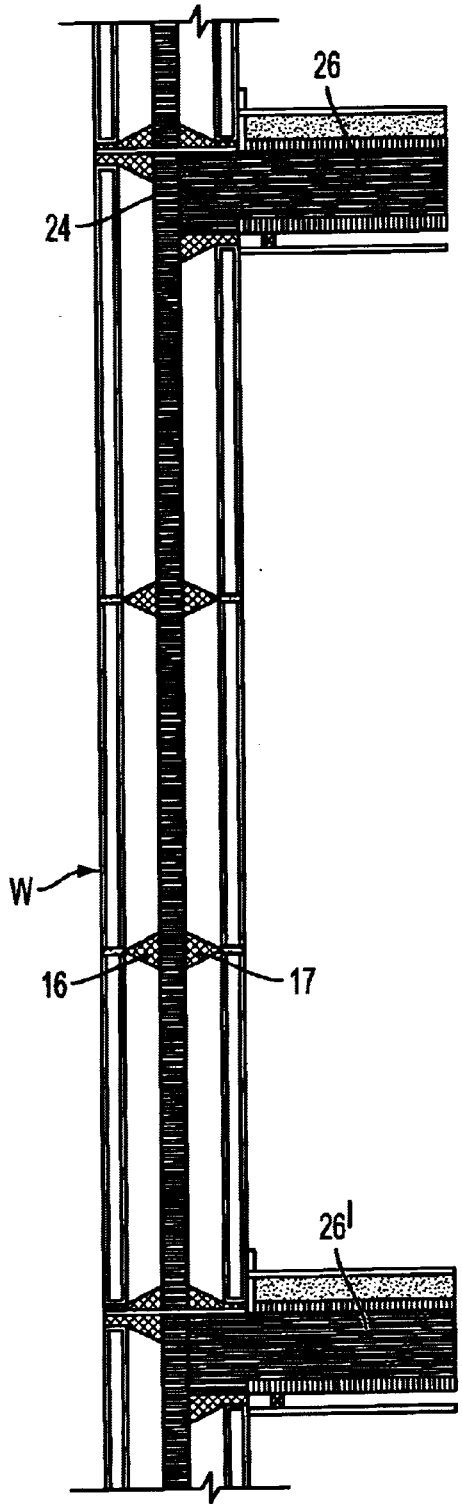
FIG. 20 shows a cross-sectional view of a portion of a building using a double panel structure formed of the elements. The side wall between the ceiling panels 26 and 26' may be similar to that shown in FIG. 9 or 11.

FIG. 20 illustrates how the structure made in the manner of FIG. 9 may be used to form the vertical outer wall W of a building. It can be seen that the wall W supports floor/ceiling 26 with respect to floor/ceiling 26'.

Figure 21:
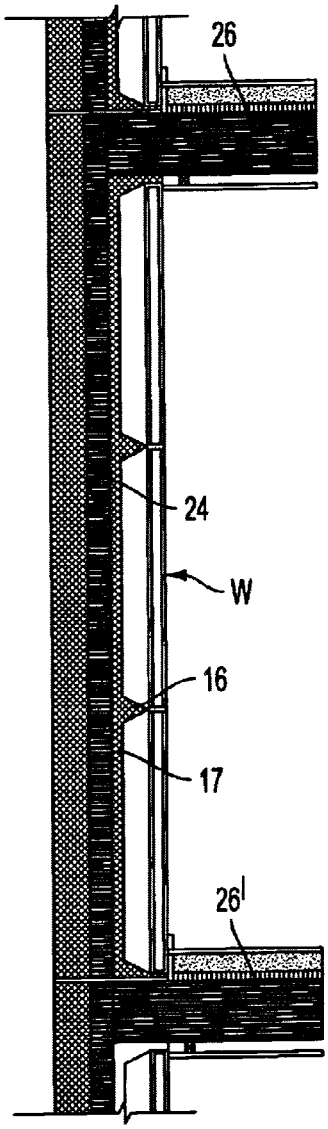
FIG. 21 shows a cross-sectional view of a portion of a building using a single panel structure formed of the elements. The side wall between the ceiling panels 26 and 26' may be similar to that shown in FIG. 13.

FIG. 21 illustrates how the structure made in the manner of FIG. 13 may be used to form the vertical outer wall W of a building. It can be seen that the wall W supports floor/ceiling 26 with respect to floor/ceiling 26'.

Figure 22:
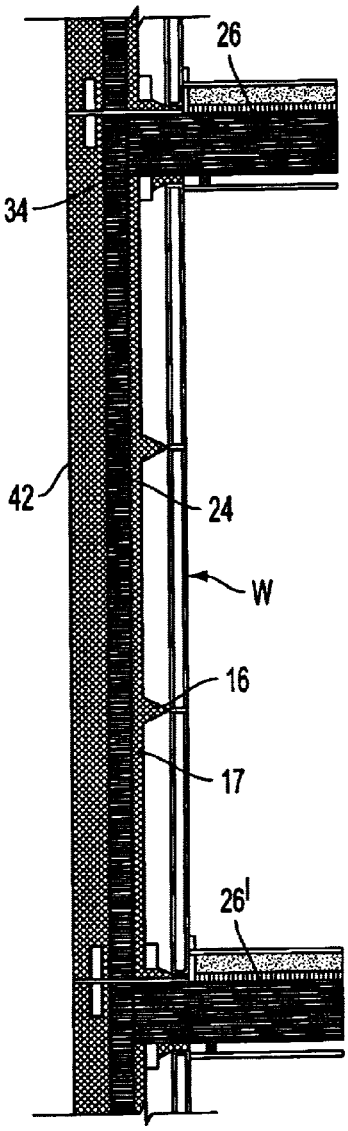
FIG. 22 shows a cross-sectional view of a portion of a building using a single panel structure formed of the elements. The side wall between the ceiling panels 26 and 26' may be similar to that shown in FIG. 14.

FIG. 22 illustrates how the structure made in the manner of FIG. 14 may be used to form the vertical outer wall W of a building. It can be seen that the wall W supports floor/ceiling 26 with respect to floor/ceiling 26'.

Figure 23:
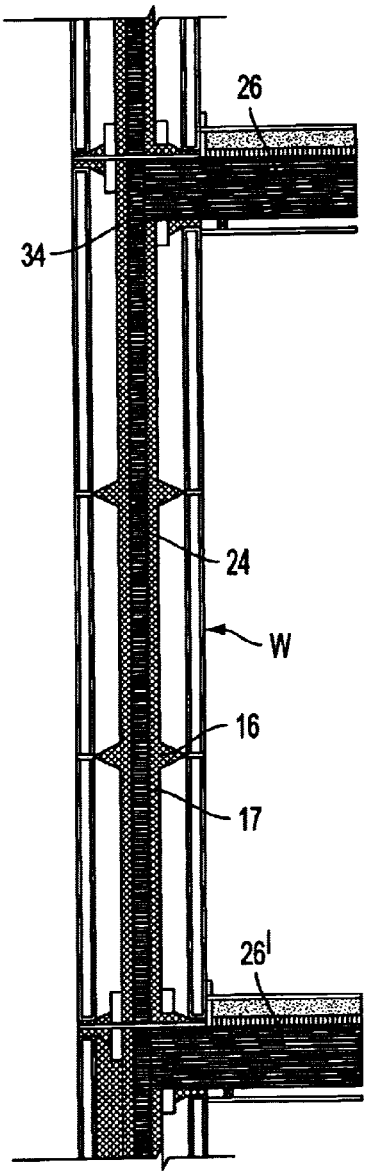
FIG. 23 shows a cross-sectional view of a portion of a building using a double panel structure formed of the elements. The side wall between the ceiling panels 26 and 26' may be similar to that shown in FIG. 11.

FIG. 23 illustrates how the structure made in the manner of FIG. 11 may be used to form the vertical outer wall W of a building. It can be seen that the wall W supports floor/ceiling 26 with respect to floor/ceiling 26'.

Figure 24:
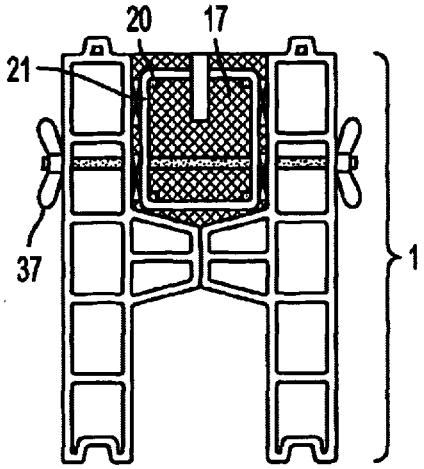
FIG. 24 shows one example of shutter case of a simple type. This design uses a connecting element to join two opposed elements, mortar, and reinforcing systems.

FIG. 24 illustrates one way to finish an end or side of a structure formed as a double wall panel. Here an outer end of two opposed elements 1 are shown connected via connecting element 37. The connecting element 37 is used to hold the opposed elements 1 while the mortar 17 is poured into the space between the elements 1. A reinforcing grid 21 and longitudinal reinforcing members 20 are used to reinforce the mortar 17.

Figure 25:
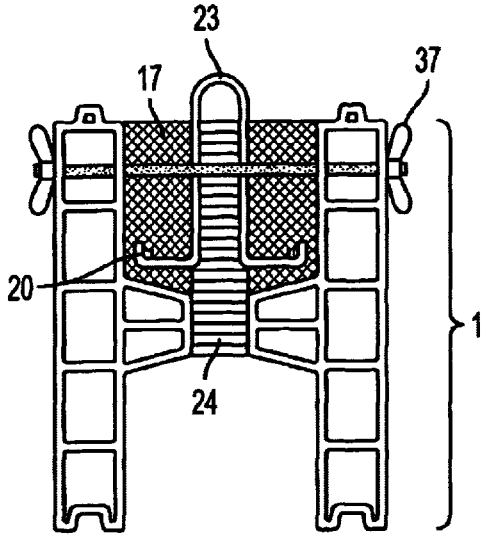
FIG. 25 shows another example of a shutter case of a simple type. This design uses a connecting element to join two opposed elements, mortar, interposed insulating material and reinforcing systems.

FIG. 25 illustrates another way to finish an end or side of a structure formed as an insulated double wall panel. Here, an outer end of two opposed elements 1 are shown connected via connecting element 37. The connecting element 37 is used to hold the opposed elements and the insulation material 24 while the mortar 17 is poured into the space between the elements 1. A reinforcing member 23 and longitudinal reinforcing members 20 are used to reinforce the mortar 17 and to connect the elements 1 through the insulation 24.

Figure 26:
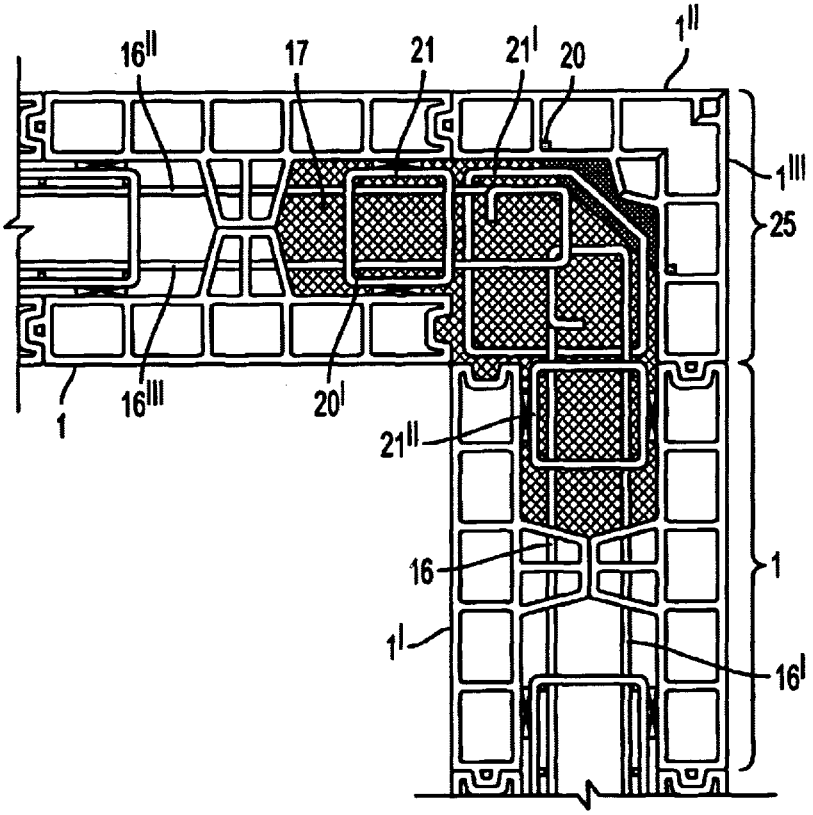
FIG. 26 shows a cross-sectional view of a corner wall structure formed of the elements. A two layer corner wall is formed butting the longitudinal sides of the internal elements 1 and 1' and an outer portion of the corner is formed using partial elements 1" and 1''', i.e., elements which have been cut or shaped to have a miter. This design uses mortar and various reinforcing systems.

FIG. 26 illustrates one way to form a building corned using the elements 1 or panel structures formed by the elements, i.e., how to finish a building corner when two double wall structures are to be joined at a right angle. Here, the inner corner is formed by butting the recess 9 ends of two elements 1 and 1' up against each other. The outer portion of the corner is formed by miter cutting the elements 1" and 1"' until they have the shape shown in the drawing. Next, reinforcing members, e.g., 16–16"', 20, 21 and 21' are placed inside the corner. The outer cut elements 1" and 1"' are then held or fastened together (not shown) while the mortar 17 is poured into the space between the elements 1–1"'.

Figure 27:
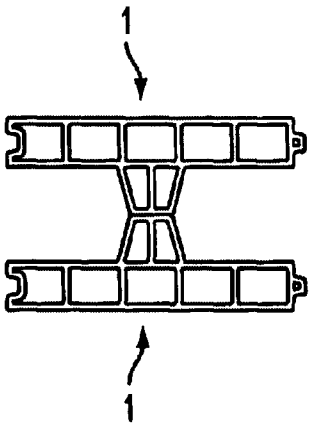
FIG. 27 shows on possible way the elements may be arranged in a brick kiln when they are being formed and/or cured.

FIG. 27 illustrates one way that two elements may be arranged when they are placed in a brick kiln. Of course, the invention also contemplates other arrangements.

Figure 28:
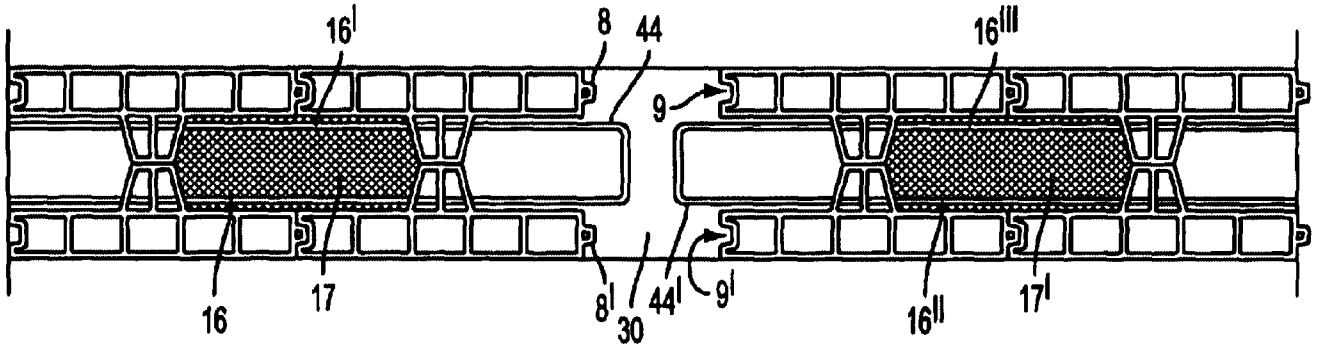
FIG. 28 shows a cross-section of one possible way in which two double layer panels may be connected. The panel on the left is joined to the panel on the right after the reinforcement ends 44 and 44' overlap and after longitudinal protrusions 8 and 8' enter longitudinal recesses 9 and 9'. The union is ensured by incorporating the reinforcing irons 16–16''', 44 and 44' in the concrete mortar.

FIG. 28 illustrates one way to join two panel structures to form the wall of a building. Each panel structure is first made using the elements 1. Then the projections 8 and 8' of one panel structure are fitted inside the recesses 9 and 9' of another panel structure until they abut against each other. This causes reinforcing members 44 and 44' to overlap. Thereafter, mortar 17 is poured into the space between the elements such that reinforcing members 44 and 44' are encapsulated (not shown).

In all aspects of the invention, the number of elements 1 used depends on the dimensions of the panel to be produced.

In the longitudinal direction of the elements 1 the number of elements in a panel may vary from a minimum of one to a maximum of six elements. In this arrangement, triangular recesses 15 are created, lined up laterally, corresponding to the number of elements 1, and the protrusions 3 also are lined up longitudinally in correspondence with the panel height desired.

After this layout operation, the reinforcing irons 16 can be placed into the triangular recesses 15 and into the V-shaped recesses extending in a transverse direction. The reinforcing rods are inserted longitudinally also into the openings of the protrusions 3 and are connected with reinforcing irons 16 at the corresponding triangular recesses 15.

The reinforcing irons 16, which extend through the triangular recesses 15 and through the V-shaped recesses may exceed the length of the panel to be prefabricated in order to permit integration with the neighboring panel. After this operation, the reinforcing grid 21 is placed onto the whole surface of the elements 1, distanced from the protrusions 3 by about 2 cm.

Special reinforcing irons 19 can also be used to connect the electro-welded grid to the reinforcing irons 16. After placement of the reinforcing elements, the concrete mortar 17 can be poured, which integrates the elements 1 as well as the reinforcing elements arranged previously into them. The concrete mortar 17 can be contained using special limiting rims on the working tables, which are of the same height as the section of the panels to be prefabricated.

The production of panels with one layer only, intended for application as interior or exterior walls, also applies for the production of single layer ceiling panels as shown in, e.g., FIG. 16. For example, ceiling panels can be made with commercially available load-bearing beams (see e.g., FIG. 10) together with the inventive elements 1 for increasing the load bearing capacity of the panel element. This can be accomplished by placing the elements 1 on a work table. Then a first row of the commercially available load-bearing beams is placed adjoining the elements on the same work table. Subsequently, the second row is placed and then the second load bearing beam, and so on, until the desired dimension is reached. The reinforcing irons 16, 16', 19, 20, 21 and 23 are placed onto the whole surface of the elements 1 and the load bearing beams, according to the orders based on the engineering statics calculations made.

The assembly process of the inventive elements 1 can be effected in a variety of different ways, which can yield the same final result. Production of the inventive elements in the brick kiln (see FIG. 27) is effected in superimposed layers, as this facilitates the placing of the inventive elements 1 on the work tables. Placement of the reinforcing irons 16, 16', 19, 20, 21 and 23 into the longitudinal openings of the inventive elements 1, or into the recesses obtained as the inventive elements are superimposed, is effected using the same method of construction according to the preceding description for the construction of single layer panels.

The reinforcing rods protrude from every row of the superimposed inventive elements 1 forming a connection with the next panel. At the connecting point of two panels with superimposed layers a recess is formed (see FIG. 28), which is integrated and reinforced in the mounting phase at the building site.

In the other way of obtaining the same panel with the inventive elements 1, two placement operations are effected on the work tables. After placement of the first layer and of the reinforcing irons 16, 16', 19, 20, 21 and 23, the second layer of inventive elements 1 is effected, the protrusions of the second layer elements being placed onto the base of the elements placed side by side before. At this point, the cement mortar 17 casting operations can begin. For obtaining a K value differing from the one of the wall according to the FIG. 8, inventive elements 1 can be used, which previously have been insulated using insulating foam 24 either in just one layer of elements, or in both superimposed layers of elements (see FIG. 12). In the construction of walls with two superimposed layers, it is also possible to insert the insulating material 24 of variable thickness between the inventive elements 1, depending on the K value to be reached, using a placement procedure similar to the one described before, but using special reinforcement elements made from Inox steel 23, which ensure the cohesion of the superimposed inventive elements 1, with the insulation 24 placed in between (see FIG. 9).

In the production of walls with two superimposed layers of simple inventive elements 1, as well as of insulated inventive elements, recesses of rhomboid form are formed (see FIG. 19), which represent a redoubled form of the isosceles recess 15 obtained by joining the bases 2 of two inventive elements. The reinforcing irons may pass through every row of inventive elements, defining an interwoven structure extending from the base of the panel up to the supports at the upper part of the panel. The reinforcing irons may also pass transversely through the superimposed inventive elements. In the casting phase of the cement mortar 17, all the recesses (V-shaped, isosceles, or rhomboid) may be filled completely with mortar, which together with the reinforcing irons lends the resistance required to the structure. Additionally, all the building types provided with the use of the inventive element 1 (walls or ceilings) can be covered inside or outside with layers of mortar 22 or plaster. Moreover, any type of exterior surface may be applied to the structures such as a ventilated curtain facade, as illustrated in FIGS. 15 and 18. Alternatively, the walls may be finished in the manner shown in FIGS. 11, 13 and 14, which show a sandwich type panel having a visible brick and/or concrete exterior surface.

Owing to the remarkable flexibility in application of the inventive elements 1 for producing diverse building types for different uses in housing construction according to the requirements concerning static or thermal characteristics, the elements may be used either on site to build custom panels, floor or wall structures, or used in the prefabrication of such structures. This may permit a drastic reduction in cost compared to the traditional building methods. The quality of the prefabricated panel elements obtained using the inventive element 1 proves superior compared to the walls produced using traditional bricks. Given the versatility of the inventive element 1, this element can be mass-produced on an industrial level by all producers of brick material. It has been possible to obtain an entirely innovative series of building types of great value under the aspects of project work, architecture, and structural behaviour.

Finally, it should be noted that the invention is not limited to the disclosed element configuration. Accordingly, the V-shaped notches can be formed as, e.g., arc-shaped, square-shaped, or trapezoidal shaped, etc., as long as they allow access to the openings 5 and 5'. Moreover, the projection 3 is not limited to its particular disclosed shape and the invention contemplates other shapes, e.g., such that sides 3*a* and 3*b* may be curved or otherwise shaped. It should also be understood that use of the term brick material is intended to encompass any material, conventional or otherwise, which is used to make bricks or blocks of the type used in the construction of buildings, including clay type materials. Finally, the invention contemplates that the element may be made by any suitable method, conventional or otherwise, by which such blocks or bricks are made, such as extrusion, casting, moulding, shaping, etc.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A brick material building element comprising:

a base comprising a length, a first side, a second side, an inner surface, and an outer surface, whereby a width is defined by a distance between the first side and the second side;

a longitudinal protrusion formed on the first side of the base;

a longitudinal recess formed on the second side of the base;

a main protrusion extending from the inner surface of the base;

the main protrusion comprising longitudinal sides and a longitudinal surface which is shorter th n the length of the base;

the longitudinal surface comprises at least one recess the longitudinal sides extending from the inner surface to the longitudinal surface and being inclined towards one another from the inner surface to the longitudinal surface;

at least one longitudinal through opening being disposed in at least one of the base and the main protrusion, wherein the longitudinal protrusion comprises an external shape which is complementary to and adapted to fit within the longitudinal recess of another brick material building element.

2. The building element of claim 1, wherein the main protrusion comprises at least one inclined end.

3. The building element of claim 2, wherein the at least one inclined end extends from the base to the longitudinal surface of the main protrusion.

4. The building element of claim 2, wherein the at least one inclined end comprises two inclined ends.

5. The building element of claim 4, wherein each of the two inclined ends extends from the base to the longitudinal surface of the main protrusion.

6. The building element of claim 1, wherein the main protrusion is centrally positioned on the inner surface of the base.

7. The building element of claim 1, wherein the main protrusion comprises a first inner inclined surface and a second inner inclined surface.

8. The building element of claim 1, wherein the main protrusion comprises two longitudinal through openings.

9. The building element of claim 1, wherein each of the base and the main protrusion comprises at least one longitudinal through opening.

10. The building element of claim 1, wherein the main protrusion is centrally located with respect to the width of the base.

11. The building element of claim 1, wherein the base comprises a plurality of longitudinal through openings and wherein the main protrusion comprises at least one longitudinal through opening.

12. The building element of claim 11, further comprising at least one wall separating at least two of the plurality of longitudinal through openings in the base.

13. The building element of claim 1, wherein the base comprises at least two longitudinal through openings and wherein the main protrusion comprises at least two longitudinal through openings.

14. The building element of claim 13, further comprising at least one wall separating at least two of the plurality of longitudinal through openings of the base and at least one wall separating the at least two longitudinal through openings of the main protrusion.

15. The building element of claim 14, wherein at least one of the walls has a thickness which is less than a width of at least one of the longitudinal through openings.

16. The building element of claim 12, wherein the at least one of the wall has a thickness which is less than a width of at least one of the longitudinal through openings.

17. The building element of claim 1, wherein the main protrusion comprises a height which, when measured from the inner surface of the base, is approximately equal to a distance between the inner surface of the base and an outer surface of the base.

18. The building element of claim 1, wherein each of the longitudinal protrusion and the longitudinal recess comprise tapered surfaces.

19. The building element of claim 1, wherein the main protrusion comprises at least one inclined end and wherein an angle $\alpha$ of inclination ranges between approximately 30° to approximately 75°.

20. The building element of claim 1, wherein the length ranges between approximately 50 cm to approximately 100 cm.

21. The building element of claim 1, wherein the width ranges between approximately 30 cm to approximately 60 cm.

22. The building element of claim 1, wherein a height "H" is defined by a distance between the longitudinal surface of the main protrusion and an outer surface of the base, and wherein the height ranges between approximately 10 cm to approximately 28 cm.

23. The building element of claim 22, wherein a height "h" of the base is defined by a distance between the inner surface of the base and an outer surface of the base, and wherein the height h is approximately equal to half of the height H.

24. The building element of claim 1, further comprising an insulating material disposed with the at least one longitudinal through opening.

25. The building element of claim 24, wherein the insulating material is adapted to improve a K value of the element.

26. The building element of claim 24, wherein the insulating material comprises a thermal insulation material.

27. The building element of claim 1, wherein the main protrusion comprises at least one other recess.

28. The building element of claim 1, wherein the at least one recess comprises a V-shaped recess.

29. The building element of claim 1, wherein the at least one recess comprises a plurality of V-shaped recesses.

30. The building element of claim 1, wherein the at least one recess has a depth that approximately equal to half a distance between the inner surface of the base and the longitudinal surface of the main protrusion.

31. The building element of claim 30, wherein the at least one recess is adapted to receive at least one of a reinforcing member and mortar.

32. A method of building a structure using a plurality of brick material building elements which each comprise the features of claim 1 the method comprising:

arranging at least two brick material building elements near each other;

connecting the at least two brick material building elements using at least one of a mortar, a cement and a concrete.

33. The method of claim 32, further comprising forming at least one of a cases for a shutter, a roller shutter, a lintels, a pilaster, a wall, a floor and a ceiling.

34. The method of claim 32, wherein the arranging further comprises arranging at least one element adjacent another element to form a single layer structure.

35. The method of claim 34, further comprising at least one of attaching and incorporating a insulation material into the single layer structure.

36. The method of claim 32, wherein the arranging further comprises arranging at least one element adjacent and opposite another element to form a double layer structure.

37. The method of claim 36, further comprising at least one of attaching and incorporating an insulation material into the double layer structure.

38. The method of claim 32, further comprising forming a structure which has a high degree of earthquake resistance.

39. The method of claim 32, further comprising incorporating at least one reinforcing member into the mortar, the cement or the concrete.

40. A brick material building element comprising:

a base comprising a length, a first side, a second side, an inner surface, and an outer surface, whereby a width is defined by a distance between the first side and the second side;

a longitudinal protrusion formed on the first side of the base;

a longitudinal recess formed on the second side of the base;

a main protrusion extending from the base;

the main protrusion being substantially centrally disposed with respect to the width and comprising longitudinal sides and a longitudinal surface which is shorter than the length of the base;

the longitudinal sides extending from the inner surface to the longitudinal surface and being inclined towards one another from the inner surface to the longitudinal surface;

at least one longitudinal through opening being disposed in the main protrusion;

at least one recess arranged on the main protrusion communicating with at least one longitudinal through openings in the main protrusion; and a plurality of longitudinal through openings being disposed in the base, wherein the longitudinal protrusion comprises an external shape which is complementary to and adapted to fit within the longitudinal recess of another brick material building element.

41. A brick material building element comprising:

a base comprising a length measured in a longitudinal direction, a first side, a second side, an inner surface, and an outer surface, whereby a width is defined by a distance between the first side and the second side;

a longitudinal protrusion having tapered sides being formed on the first side of the base;

a longitudinal recess having tapered sides formed on the second side of the base;

a main protrusion extending from the base;

the main protrusion being substantially centrally disposed with respect to the width and comprising longitudinal sides and a longitudinal surface;

the longitudinal surface being arranged between two inclined portions;

the two inclined portions inclining towards one another such that a length of the longitudinal surface, measured in the length direction, is less than the inner surface measured in length direction;

the longitudinal sides being inclined towards one another such that a distance between the longitudinal sides, measured in the width direction, is greater at the inner surface than at the longitudinal surface;

at least one longitudinal through opening being disposed in the main protrusion;

at least one recess arranged on the main protrusion communicating with the at least one longitudinal through opening; and a plurality of longitudinal through openings and connecting walls being disposed in the base, wherein the longitudinal protrusion comprises an external shape which is complementary to and adapted to fit within the longitudinal recess of another brick material building element.

42. The building element of claim 41, wherein the at least one recess comprises a plurality of recesses.

43. The building element of claim 42, wherein each of the plurality of recesses comprises a V-shape.

* * * * *